US008157265B2

(12) United States Patent
Conville et al.

(10) Patent No.: US 8,157,265 B2
(45) Date of Patent: Apr. 17, 2012

(54) BAG TOSSING GAME WITH ACCESSORY STABILIZATION

(75) Inventors: Kirk A. Conville, Hot Springs, AR (US); David J. Conville, Hot Springs, AR (US)

(73) Assignee: Baggo, Inc., Hot Springs, AR (US)

( * ) Notice: Subject to any disclaimer, the term of this patent is extended or adjusted under 35 U.S.C. 154(b) by 0 days.

(21) Appl. No.: 12/660,855

(22) Filed: Mar. 5, 2010

(65) Prior Publication Data

US 2011/0215528 A1 Sep. 8, 2011

(51) Int. Cl.
*A63B 63/00* (2006.01)

(52) U.S. Cl. ..... 273/402

(58) Field of Classification Search ..... 273/398–402
See application file for complete search history.

(56) References Cited

U.S. PATENT DOCUMENTS

| | | | | | |
|---|---|---|---|---|---|
| 285,396 | A | | 9/1883 | Windt | |
| 922,717 | A | | 5/1909 | Parker | |
| 1,636,920 | A | | 7/1927 | Nichols | |
| 2,021,989 | A | | 11/1935 | Master | |
| 2,050,914 | A | | 8/1936 | Anderson | |
| 2,291,104 | A | | 7/1942 | Radzyner | |
| 3,628,793 | A | | 12/1971 | Mudloff | |
| 3,837,650 | A | | 9/1974 | Haney | |
| 4,012,042 | A | * | 3/1977 | Blasingame | 273/401 |
| 4,022,472 | A | * | 5/1977 | Seals | 273/400 |
| 4,186,925 | A | | 2/1980 | Goldfarb | |
| 4,243,229 | A | | 1/1981 | Huser | |
| 4,326,722 | A | * | 4/1982 | Dickens | 273/400 |
| 4,565,375 | A | * | 1/1986 | Dresel | 273/401 |
| 4,709,929 | A | | 12/1987 | Mills | |
| 4,726,591 | A | * | 2/1988 | Johnson | 273/339 |
| 4,877,256 | A | | 10/1989 | Falloon | |
| 4,923,201 | A | | 5/1990 | Nichol | |
| 4,927,160 | A | | 5/1990 | Nichol | |
| 4,938,485 | A | | 7/1990 | Hockridge | |
| 4,943,065 | A | | 7/1990 | DeLapa | |
| 4,961,586 | A | | 10/1990 | Conville | |
| 4,974,858 | A | | 12/1990 | Knowlton | |
| 4,986,549 | A | | 1/1991 | Kuhtic | |
| 4,989,880 | A | | 2/1991 | Gettemeier | |
| 5,050,889 | A | | 9/1991 | Walker | |
| 5,056,796 | A | | 10/1991 | Conville | |
| 5,056,797 | A | | 10/1991 | Hockert | |
| 5,110,139 | A | | 5/1992 | Baumgartner | |
| 5,165,695 | A | | 11/1992 | Yoder | |
| 5,201,527 | A | | 4/1993 | Koket | |
| D340,082 | S | | 10/1993 | DeLapa | |
| 5,320,360 | A | * | 6/1994 | St. Pierre | 273/402 |
| 5,332,230 | A | | 7/1994 | Benedict | |

(Continued)

*Primary Examiner* — Mark Graham
(74) *Attorney, Agent, or Firm* — Stephen D. Carver

(57) ABSTRACT

A bag tossing game for one or more by players comprises foldably deployable target assemblies, associated stabilizing assemblies linked to the target assemblies, and a plurality of bags for throwing by players. Each target assembly presents an inclined impact surface with a target aperture towards which bags are thrown. A foldable elevator pivoted to the target assembly angles the target assembly during play. Foldable feet at an opposite end of the target assemblies offer further support. A stabilizing assembly associated with each target assembly comprises a base disposed on the supporting surface, a platform mounted over the base for supporting bags and beverages and an elongated stanchion extending upwardly from a socket in the base for supporting the platform. The base comprises an elongated slot and cooperating guide channels for interconnecting each target assembly elevator with the stabilizing assembly.

6 Claims, 13 Drawing Sheets

U.S. PATENT DOCUMENTS 5,333,879 A * 8/1994 Barnes ..... 273/400
5,397,130 A * 3/1995 Brown ..... 273/348
D363,953 S 11/1995 Buse
D369,188 S 4/1996 Briggs
5,553,862 A 9/1996 Konotopsky
D375,125 S 10/1996 Mallek
D375,530 S 11/1996 Rudd
5,575,480 A 11/1996 Wehr
D382,601 S 8/1997 Antill
5,755,439 A 5/1998 Turner
D405,474 S 2/1999 Trondson
5,871,216 A * 2/1999 Sparacino ..... 273/402
D408,462 S 4/1999 Fryez
5,909,877 A 6/1999 Bour
D416,947 S 11/1999 Coutu
6,068,260 A 5/2000 Dean
6,161,833 A 12/2000 Gomez
6,244,598 B1 6/2001 Conville
6,296,249 B1 10/2001 Mogensen
6,341,780 B1 1/2002 Pant
6,464,226 B1 10/2002 Kephart
D474,246 S 5/2003 Carr
6,866,268 B2 3/2005 Christianson
6,932,344 B1 8/2005 Soto
6,932,345 B1 * 8/2005 O'Dell ..... 273/402
D544,041 S 6/2007 Murphy
D545,911 S 7/2007 Verni
7,237,777 B2 7/2007 Digges, III
D548,286 S 8/2007 Taylor
7,314,420 B2 1/2008 Knoistant
7,607,666 B1 * 10/2009 Studier ..... 273/400
D604,977 S * 12/2009 Conville ..... D6/552
7,775,525 B2 * 8/2010 Staver et al. ..... 273/317.5
2002/0079645 A1 6/2002 Brown
2004/0108658 A1 6/2004 Bartel
2004/0178584 A1 9/2004 Fairbanks
2004/0239036 A1 12/2004 Fairbanks
2005/0127609 A1 6/2005 Raslowsky
2006/0038341 A1 2/2006 Konstant
2006/0125186 A1 6/2006 Digges, III
2007/0045964 A1 * 3/2007 Petras ..... 273/317
2007/0063447 A1 3/2007 Gholson
2007/0080499 A1 4/2007 Greiwe
2008/0042360 A1 2/2008 Veikley
2008/0116644 A1 5/2008 Knoernschild
2008/0157476 A1 7/2008 Striebel
2008/0179833 A1 * 7/2008 Held et al. ..... 273/402
2009/0295093 A1 * 12/2009 Kiernan ..... 273/317.2
2010/0044964 A1 * 2/2010 Constantine et al. ..... 273/378
2010/0194047 A1 * 8/2010 Sauerwine ..... 273/400

* cited by examiner

BAG TOSSING GAME WITH ACCESSORY STABILIZATION

CROSS-REFERENCE TO RELATED APPLICATIONS

This application is based upon and claims the benefit of the filing date of previously filed, co-pending U.S. Provisional Patent Application, entitled Bag Tossing Game with Accessory Stabilizing Shelf, Ser. No. 60/209,895, Filed Mar. 13, 2009, by inventor Kirk Conville.

BACKGROUND OF THE INVENTION

I. Field of the Invention

This invention relates generally to portable games wherein one or more players toss projectiles, preferably bags, at inclined, apertured, wedge-shaped targets. More particularly, this invention relates to tossing games of the latter type that are structurally adapted to accommodate related activities for enhancing stability of the target board. Prior art game patents known to me are found in Class 273, Subclasses 398, and 400, 401, and 402.

II. Description of the Prior Art

Prior art tossing games include a wide variety of different projectiles that are thrown towards various targets of different sizes and shapes. Typical prior art projectiles include metallic darts, golf balls, softballs, baseballs, footballs, discs, horse shoes, bean bags and the like. The prior art also includes numerous games using inclined, targets having an apertured front surface through which a projectile can pass. Relatively recently, bean bags have replaced other projectiles for safety reasons. Bag tossing games utilizing molded, plastic target assemblies are known in the art. Earlier tossing games were made of wood or metal, but plastic versions have become more popular. Less expensive, lightweight bag tossing games can also be made of cardboard or corrugated material.

An older tossing game with apertured, inclined planes that function as targets is disclosed in U.S. Pat. No. 2,021,989, issued Nov. 26, 1935. The latter reference discloses an inclined plane functioning as a target that includes a central aperture. When balls are tossed by a player towards the target, they may be collected within a captivated collection pocket if they penetrate the target orifice.

U.S. Pat. No. 3,628,793, issued Dec. 21, 1971, and entitled "Sandbag and Target Apparatus," discloses a pair of fixed. wedge-shaped half sections, each including an apertured and inclined plane functioning as a target. Individual wedge-shaped sections may be deployed separately in a tossing game configuration, or they may be clamped together in the form of a parallelepiped for storage or transportation. The target sections are relatively cumbersome and heavy, making convenient transportation and deployment difficult.

U.S. Pat. No. 3,837,650 issued Sep. 24, 1974, comprises a foldable, reinforced wooden tossing game.

U.S. Pat. No. 4,709,929 issued Dec. 1, 1987 discloses a pair of apertured game boards that function as targets. They can be separated for play or coupled together for transportation or storage.

U.S. Pat. No. 3,480,280, issued Nov. 25, 1969 discloses a bean bag design for a projectile suitable for in bag tossing games.

U.S. Pat. No. 5,165,695 issued Nov. 24, 1992 discloses a transportable bag tossing game for one or more players having multiple scoring methods. The target structures are injection molded. The object of the game is to direct projectiles through an aperture contained on the second wall.

U.S. Pat. No. 5,332,230 issued Jul. 26, 1994 discloses a foldable target structure for bag toss games that comprises multiple game plates for presenting distinctive geometrical configurations.

U.S. Pat. No. 5,333,879 issued Aug. 2, 1994 discloses a bag tossing game using a target board with a plurality of upwardly extending projections forming a numerous of target areas. Different target thus introduce varying degrees of playing difficulty.

U.S. Pat. No. 5,765,832 issued Jun. 16, 1998 shows a target game apparatus with a forwardly-angled, target impact panel supporting a rotatable target. A plurality of different sized openings in the target can be aligned with an enlarged aperture in the impact panel. U.S. Pat. No. 5,909,877 issued Jun. 8, 1999 discloses a bean bag toss game target with hinged panels that are moveable between a first, in-use configuration and a second, folded configuration. The first panel has a target hole.

U.S. Pat. No. 6,296,249 issued Oct. 2, 2001 discloses a disc tossing game for multiple players having a generally rectangular target with convex landing surface and pockets. Discs are tossed onto the target to score points according to rules.

U.S. Pat. No. 6,341,780 issued Jan. 29, 2002 discloses another disc tossing game with target boards and a plurality of discs. The target boards have various holes that are penetrated to score points.

U.S. Pat. No. 6,932,345 issued Aug. 23, 2005 discloses a portable bean bag toss game Including target assemblies that have a beverage supporting section removably attachable to the rear.

Other tossing games involving analogous projectiles and inclined target surfaces are disclosed in U.S. Pat. Nos. 3,554,550; 4,186,925; 4,116,443; 4,943,065, 5,165,695 7,237,777, and U.S. Pat. Applications 2002/0079645, 2005/0023762, and 2005/0127609.

Prior U.S. Pat. No. 4,961,586, also owned by Baggo Inc. discloses a tossing game for use by multiple players that has blow-molded targets with circular target apertures defined on the target faces. The targets can be quickly transformed between transportation modes and playing modes. In the transport mode they are coupled together, forming a parallelepiped, which facilitates storage and transportation. In the playing mode, the modular, wedge-shaped targets are separated from one another. Each of the wedge-shaped, and inclined targets presents an apertured playing board towards which bean bags are thrown. Each target comprises a separate, removable, elevator tray that is snap fitted to the boards to incline them for play. The trays also prevent bags dropping through the target hole from escaping the board underside. A brace extending from the board underside reinforces the trays during play. However, the brace has in some cases been insufficient to prevent undesired target movement.

Prior U.S. Pat. No. 5,056,796 that is also owned by Baggo Inc. discloses a similar tossing game. Again, twin, blow molded, wedge shaped target assemblies are switched between transportation modes and game modes. In the playing mode they are detached, separated, and then deployed by the players in spaced-apart relation. Each of the wedge-shaped, modular targets comprises an inclined, apertured surface towards which bean bags are thrown to generate points in accordance with rules. During deployment, each target board is inclined by unfolding elevator trays that are pivotally coupled to the target underside. The beanbags are stored within interior compartments.

In U.S. Pat. No. 6,244,598 issued Jun. 12, 2001, and owned by Baggo Inc., a foldable corrugated bag tossing game is disclosed. A pair of wedge-shaped target assemblies are erected by unfolding a unitary corrugated blank. Each target assembly presents an outer, inclined, surface comprising a target orifice. The blank has a central panel forming the outer surface, a pair of foldable sides forming a fluteless bottom, and a front and a rear each having two foldable panels that present a fluteless bottom. To minimize wear, each target orifice is snap-fitted with a plastic reinforcement ring that also seals out moisture. Stabilizer ribs formed from corrugated blanks extend transversely beneath the target assemblies between the folded sides to reinforce the target assemblies and reduce bouncing. However, certain bouncing and instability problems occurring upon target impact have not been solved.

Old, relatively heavier wooden games are too heavy for practical marketing or convenient transportation and stowage. Their weight and bulk makes shipping and inventory costs prohibitive for modern retailers. Modern designs, transformable between storage and play configurations, use plastic components that are molded. As a result, many designs are lightweight. Robust plastic designs may include strengthening aspects, such as reinforcement ribs, but since they are relatively lightweight, they can move during impact. In other words, the targets are sometimes displaced from "official" positions in response to forceful impacts. While slight target movements are irrelevant to casual players, serious tournament players often object to impact-driven positioning changes. Stability of the target assembly is advantageous for promoting fairness and compliance with game rules.

Additionally, it has been hitherto inconvenient when playing typical plastic, modularized bag toss games to store beverages or bags during play. When a game is deployed in one's backyard over the lawn, for example, lawn furniture may not be handy. On a hot summer afternoon all players are likely to be provided beverages, and for accurate play, the beverage containers should be stowed while throwing. Moreover, players often seek temporary resting places for cell phones, car keys and the like. No known bag tossing game readily answers the twin challenges of stable target positioning with eased accessory storage. No known bag tossing target includes accessory structure that provides temporary beverage container storage and toss bag storage during play. Further, no known prior art bag toss game has a score keeping mechanism incorporated into an analogous stabilizing activities assembly.

No known prior art bag tossing game utilizes an upright, vertical support stanchion attachment and shelf combination that interfits mechanically with the wedge shaped target assemblies. None of the bag tossing games in the prior art have employed such an upright shelf that enhances target stability, while concurrently storing playing bags, beverages that may be consumed during play.

SUMMARY OF THE INVENTION

An improved bag tossing game for one or more by players comprises a pair of playing stations that can be deployed for play in a stable position, or foldably secured in a cooperating storage position for transportation. Each target assembly comprises a generally wedge shaped impact target, a deployable stabilizing accessory assembly for each target, and a plurality of corn-filled bags thrown by the players during the game. To minimize shifting or movements of the target assemblies in response to bag impact, the stabilizing assemblies are structurally interconnected with the target assemblies during deployment.

Each target assembly presents an inclined impact surface with a target aperture towards which bags are thrown. To properly angle the target assemblies for play, a generally rectangular elevator is foldably pivoted to the target assembly. The elevators can be switched between flat, non-obtrusive storage positions, and play positions that angle the target impact surface. Preferably there are foldable feet at opposite ends of the target assemblies for additional support. The accessory stabilizing assembly associated with each of target assembly comprises a base disposed on the supporting surface, a platform mounted over the base functioning as a shelf for supporting bags, beverages, and the like, an elongated support stanchion extending upwardly from the base. Sockets are defined in the base structure for quick coupling to the support stanchion when the game is deployed. The base comprises an elongated slot and cooperating guide channels that register with portions of the target assembly elevator when assembled.

Thus a basic object of the invention is to provide a modular tossing game that stabilizes the target assemblies during play while performing related activities.

Another basic object of the invention is to provide a high quality bag tossing game with stable target assemblies that, when deployed in the play mode, resist impact from bags thrown at them and minimize target movement.

Yet another basic object is to provide a projectile tossing game of the character described that includes stabilized targets that minimize impact-related movement.

It is also a fundamental object to integrate game-related activities such as score keeping, bag storage and retention, beverage supporting and the like with stabilizing structure that enhances game play and player satisfaction.

It is also a fundamental object to integrate game-related activities with stabilizing structure that is consolidated in unitary target units.

Another object of our invention is to provide a bag tossing game of the character described that provides players with convenient, elevated bag storage proximate the playing position for convenient access.

A similar related object is to a bag tossing game of the character described that provides players with a convenient, elevated resting place for beverage drinks, ash trays, score keeping, target illumination lighting and the like.

Another broad object is to provide elevated and stable cup holders for a bag toss game.

It is also a broad object is to provide an elevated shelf or platform for a bag tossing game that interconnects with the target assemblies.

Another object is to provide a bag tossing game of the character described including target modules and an elevated storage shelf, all of which may be quickly and easily switched between transportable and playing orientations.

Another important object of the present invention is to provide a bag tossing game of the character described having an accessory storage shelf.

Another object of the present invention is to provide a bag toss game accessory of the character described whose target surface can receive and support and display advertisements for unrelated goods and services. This feature is especially significant in conjunction with corrugated versions of the bag toss game.

Yet another fundamental object of the present invention is to provide a bag toss game of the character described using modularized and compartmentalized target assemblies that can be folded together into one unitary carrying piece, with the accessory structure and its support shelf, the player bean bags, and other parts firmly secured therewithin.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
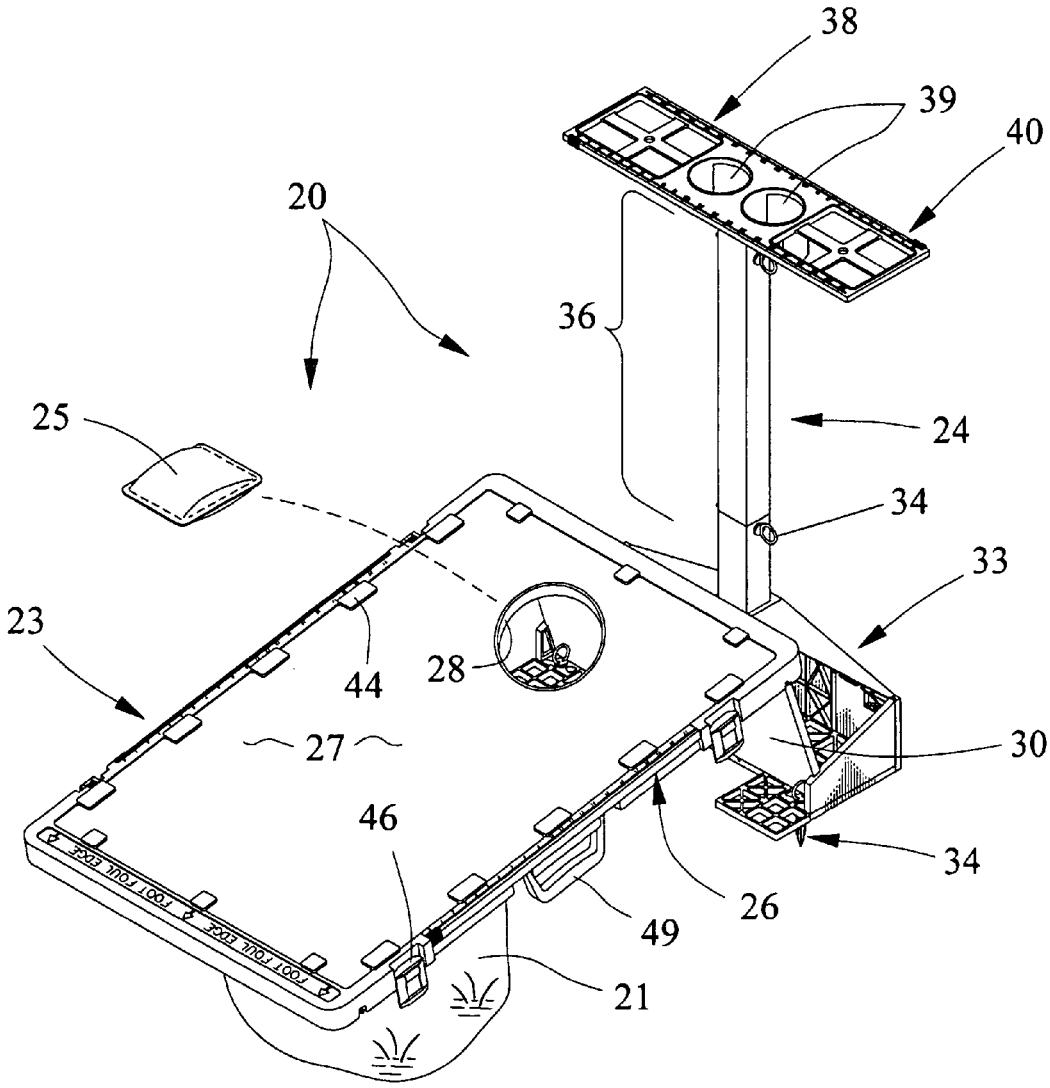
FIG. 1 is frontal isometric view of a tossing game play station constructed in accordance with the best mode of the invention, illustrating a single wedge-shaped target assembly linked to a stabilizing assembly with an elevated support shelf.
Figure 2:
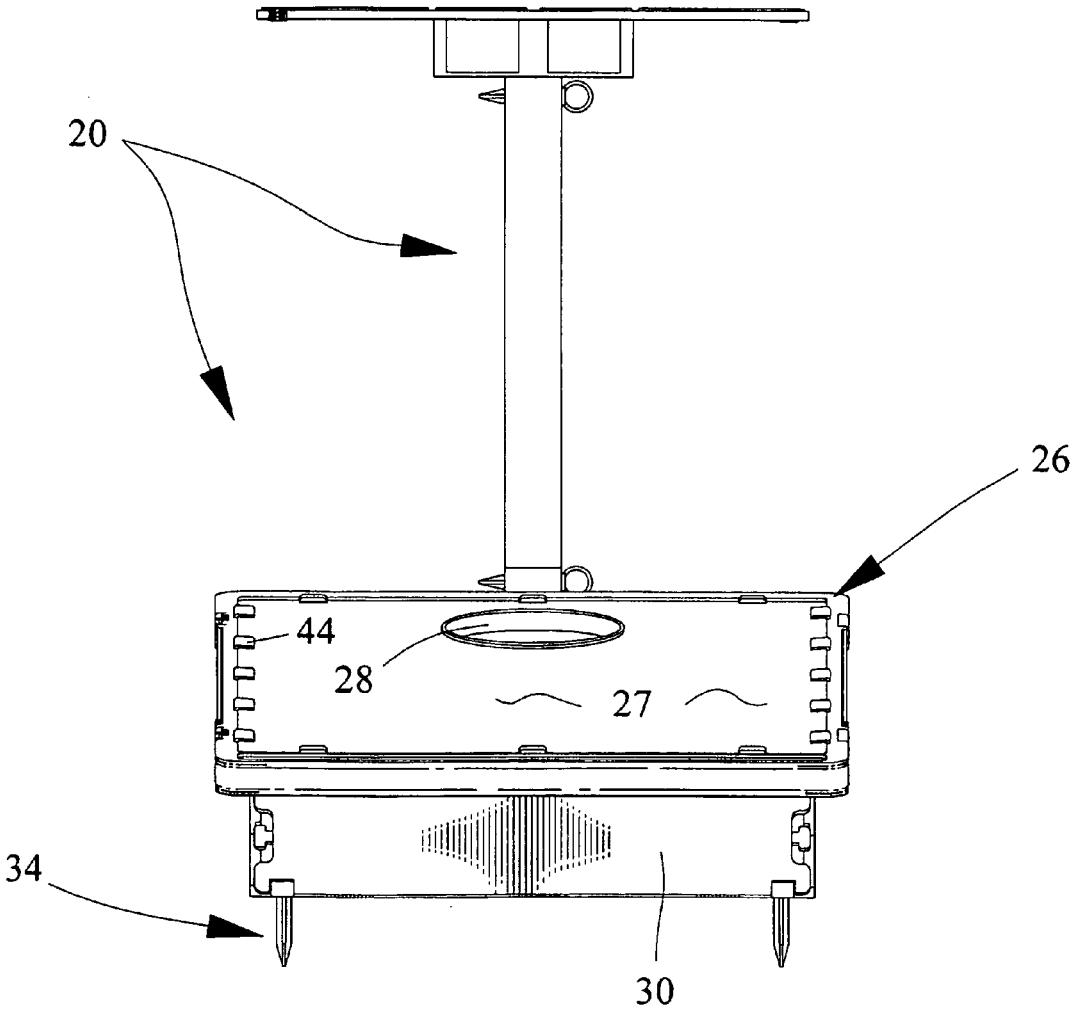
FIG. 2 is an enlarged front elevational view thereof.
Figure 3:
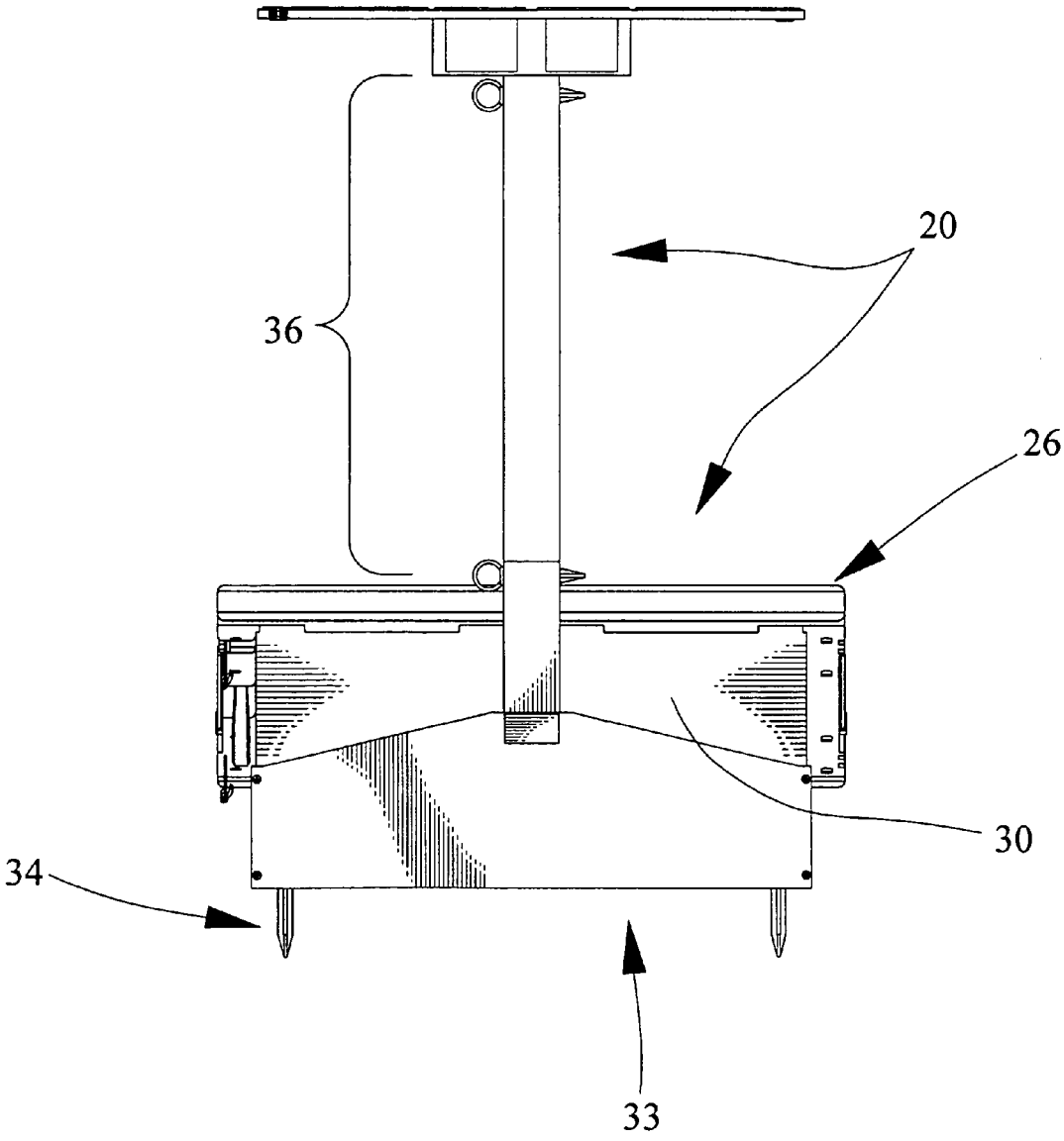
FIG. 3 is a rear elevational view thereof.
Figure 4:
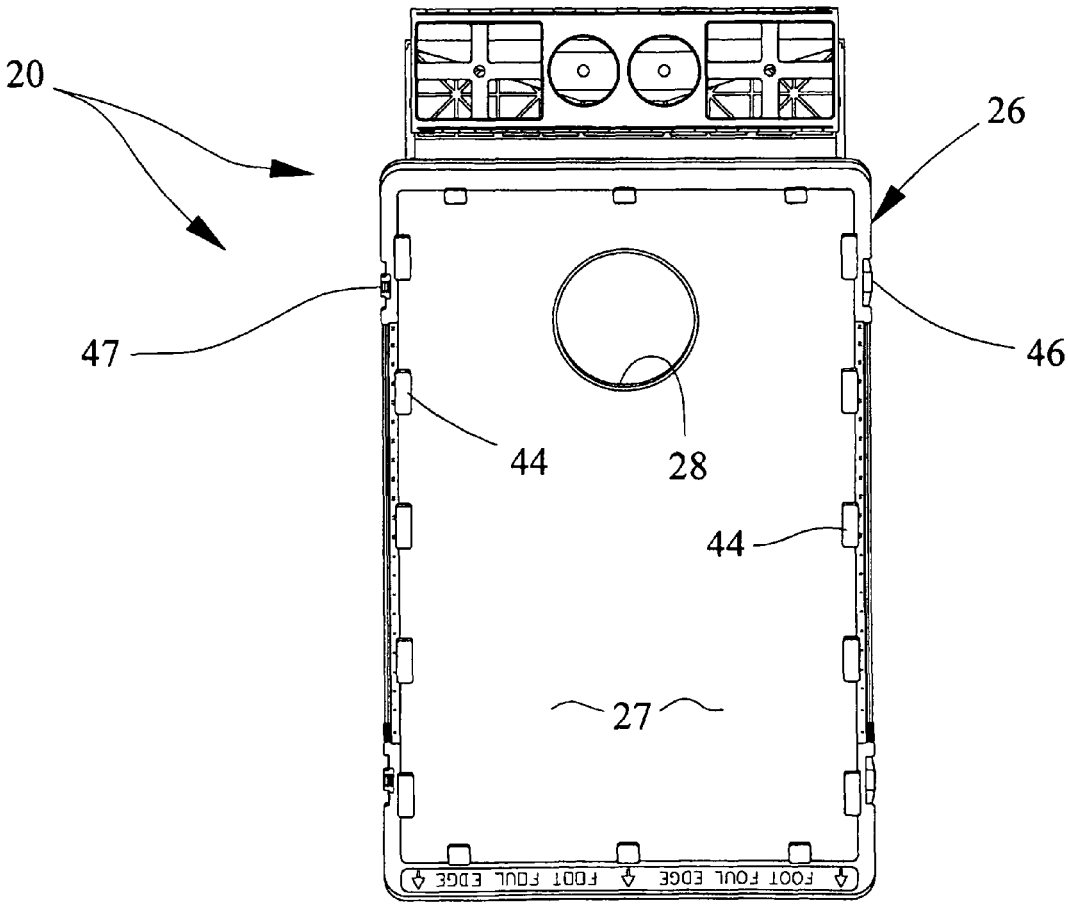
FIG. 4 is a top plan view thereof.

With initial reference directed to FIGS. 1-7 of the appended drawings, a portion of our projectile tossing game constructed generally in accordance with the best mode of the invention has been generally designated by the reference numeral 20. In actual play, there will be two similar game play stations, one for each player. The game is adapted to be disposed over a suitable flat, supporting surface such as ground 21, and, as explained later, means are preferably provided for anchoring the apparatus to the ground to prevent movement during play. Each of the two game stations used in play comprises a somewhat wedge-shaped target assembly 23 towards which projectiles 25 are thrown, and a cooperating stabilizing assembly 24, to which the target assemblies 23 are preferably mechanically coupled during play. The preferred projectiles are corn-filled bags or "bean bags", which are distinctively colored to denominate different players or teams of players.

The target assemblies 23 can be configured in different ways, and they can be made of different materials. Details of target assembly construction are outlined in prior U.S. Pat. Nos. 4,961,586, 5,056,796, and 6,244,598, all owned by Baggo Inc., which are hereby incorporated by reference for purposes of disclosure.

The preferably molded plastic target frame 26 is generally rectangular, and during play it is disposed at an inclination. Frame 26 has an exposed target surface 27 including a target orifice 28 through which bags 25 (or other projectiles) may pass during play for maximum scoring. The target frame 26 is preferably elevated at its rear by a planar elevator 30 that transversely interconnects with the stabilizing assembly 24 (i.e., FIGS. 1, 7) for stability. Elevator 30 can be folded between a deployed orientation, and a flat, relatively compact storage position. Preferably a pair of foldable front feet 31 can be deployed to elevate the target front slightly, as seen for example, in FIG. 6. The stabilizing assembly base 33 includes means for receiving the rear target elevator 30 so that the stabilizing assembly 24 is mechanically linked to the target assembly during play for stabilization.

The base 33 is preferably secured to the ground 21 by anchor means 34, preferably comprising user-deployable pegs or pins, discussed later. An elongated, multi-piece stanchion 36 extends vertically upwardly from the base 33 to support a shelf or platform 38 vertically above the ground 21 within the convenient reach of a player (not shown). The shelf or platform 38 is in the form of a generally horizontally disposed surface. Preferably shelf 38 comprises at least one cup or beverage receptacle 39, and a pair of convenient, spaced apart storage regions 40 upon which bags or the players' cell phone or other items may be temporarily placed.

Figure 5:
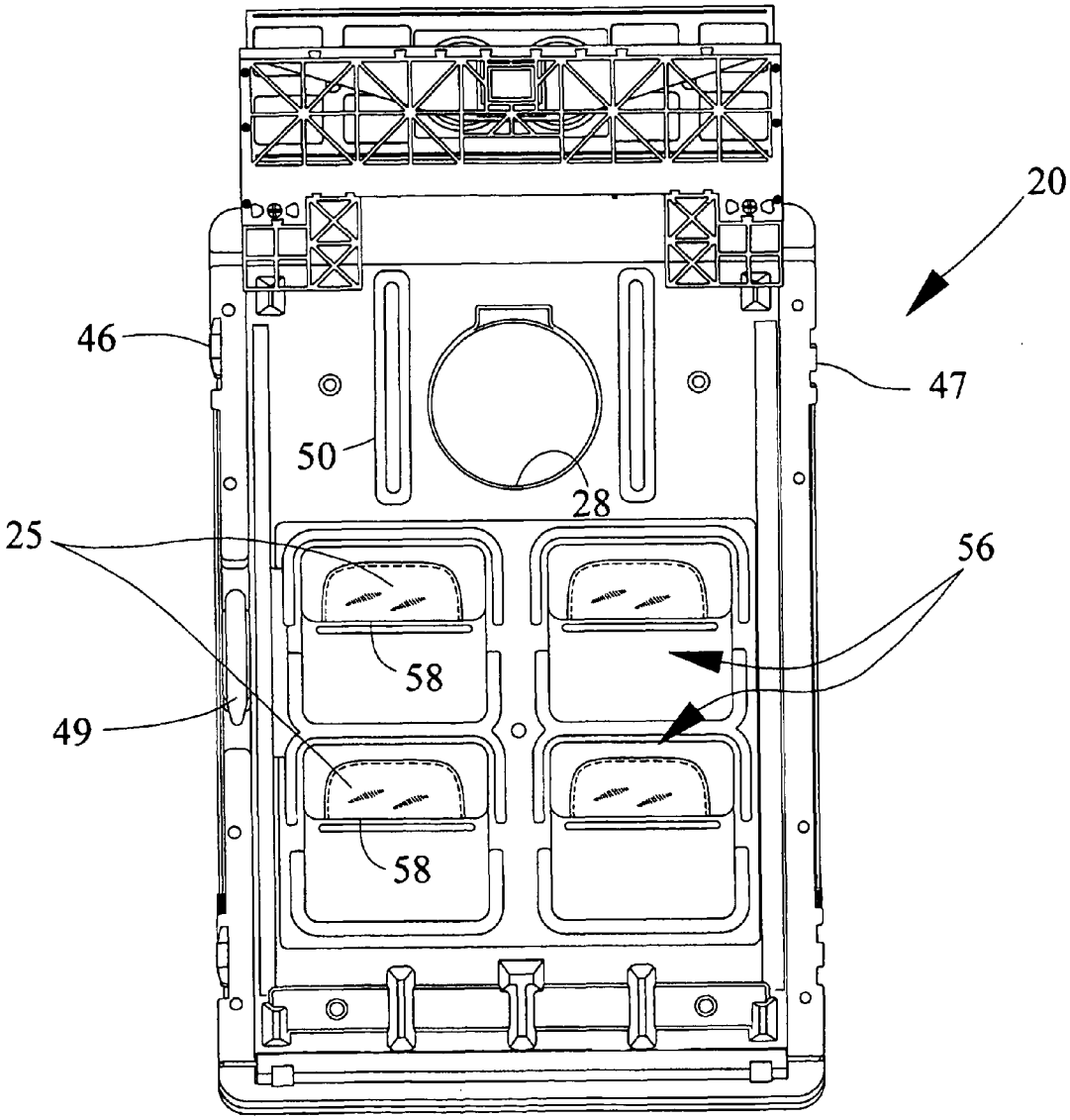
FIG. 5 is a bottom plan view thereof.
Figure 6:
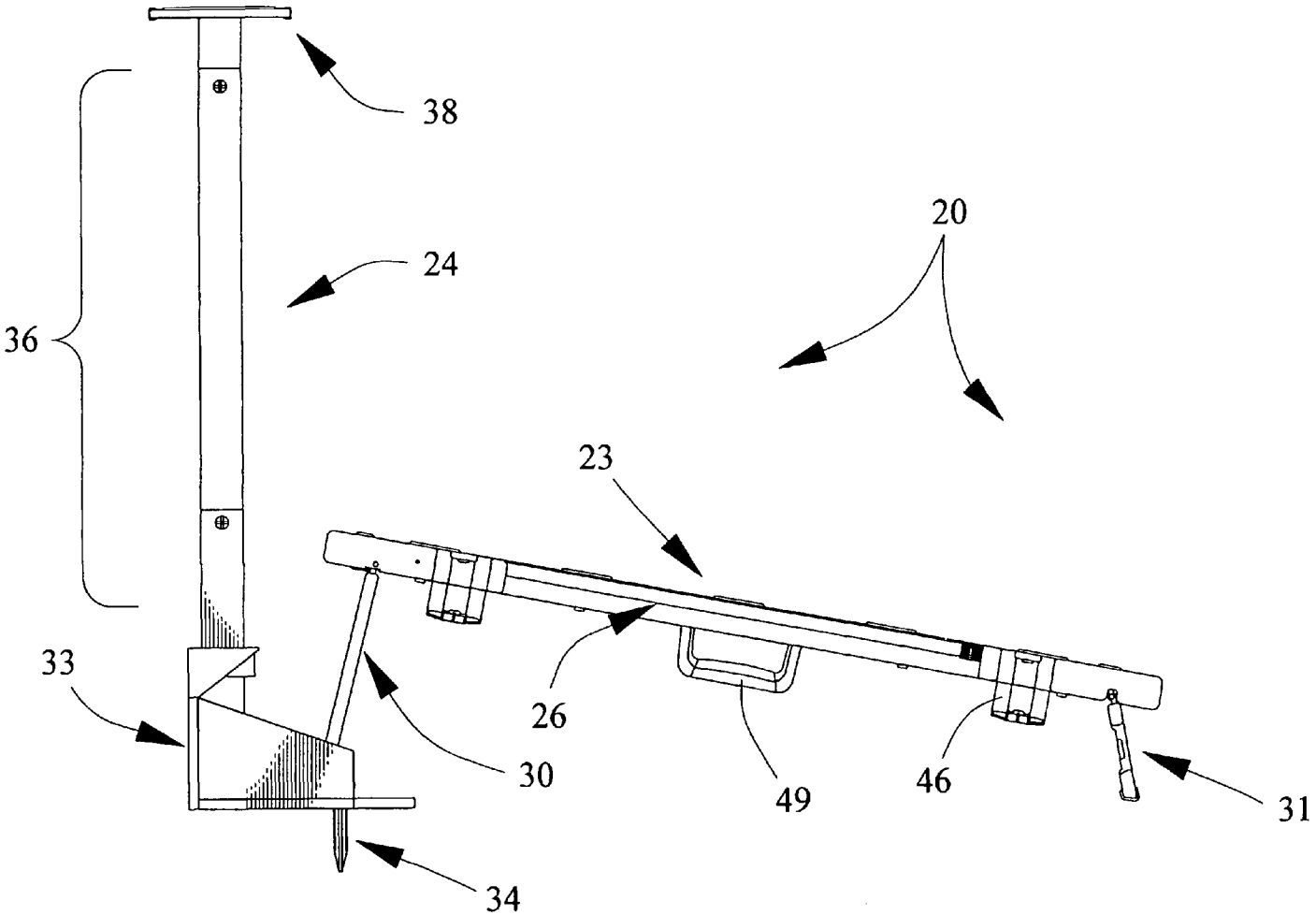
FIG. 6 is a left side elevational view thereof.

With primary attention directed now to FIGS. 4-7, the exposed playing surface 27 of each target assembly frame 26 is surrounded about its periphery by a plurality of regularly spaced apart tabs 44. Preferably advertising indicia, generally rectangular in shape and including an orifice to align with target orifice 28, is placed upon the playing surface 27, where it is retained by tabs 44. In the best mode each frame 26 includes a pair of standard locking latches 46 on each side that can engage complimentary clasps 47 on the other side of the frame to selectively lock a pair of target assemblies together for stowage or transportation, as is known in the art. Before the latches 46 are deployed, the generally rectangular elevator 30 is folded inwardly, where it will lie beneath orifice 28 against the underside of the frame, supported against rectangular reinforcement ribs 50 (FIG. 5). Feet 31 are similarly folded, and once the latches 46 are fastened, the target assemblies can be conveniently carried by handle 49. A plurality of corn filled toss bags 25 can be stored if desired in the preferably four recessed compartments 56 beneath the frame 26 (FIG. 5). Each compartment 56 preferably includes an elastic bag retainer 58 for restraining the bags.

With attention now directed mainly to FIGS. 8-14, the stabilizing assembly 24 comprises a plurality of cooperating plastic parts that are preferably molded. The base 33 comprises a generally planar bottom 60 that preferably is not solid; instead it includes a plurality of ornamental strengthening ribs 62, 63 (FIG. 13) arranged in a pattern generally between front and rear lips 67, 68 respectively. At its opposite ends, bottom 60 is bounded by a pair of rigid plastic sidewalls 70, 71 (i.e., FIGS. 8, 10, 11) that are generally triangular, tapering in height towards the front of the assembly. A rigid end wall 73 is orthogonal with respect to sidewalls 70 and 71 and bottom 60. An upper shroud 75 comprising a pair of generally triangular segments overlies the end wall 73, spaced apart from bottom 60, to provide a partial enclosure.

Figure 8:
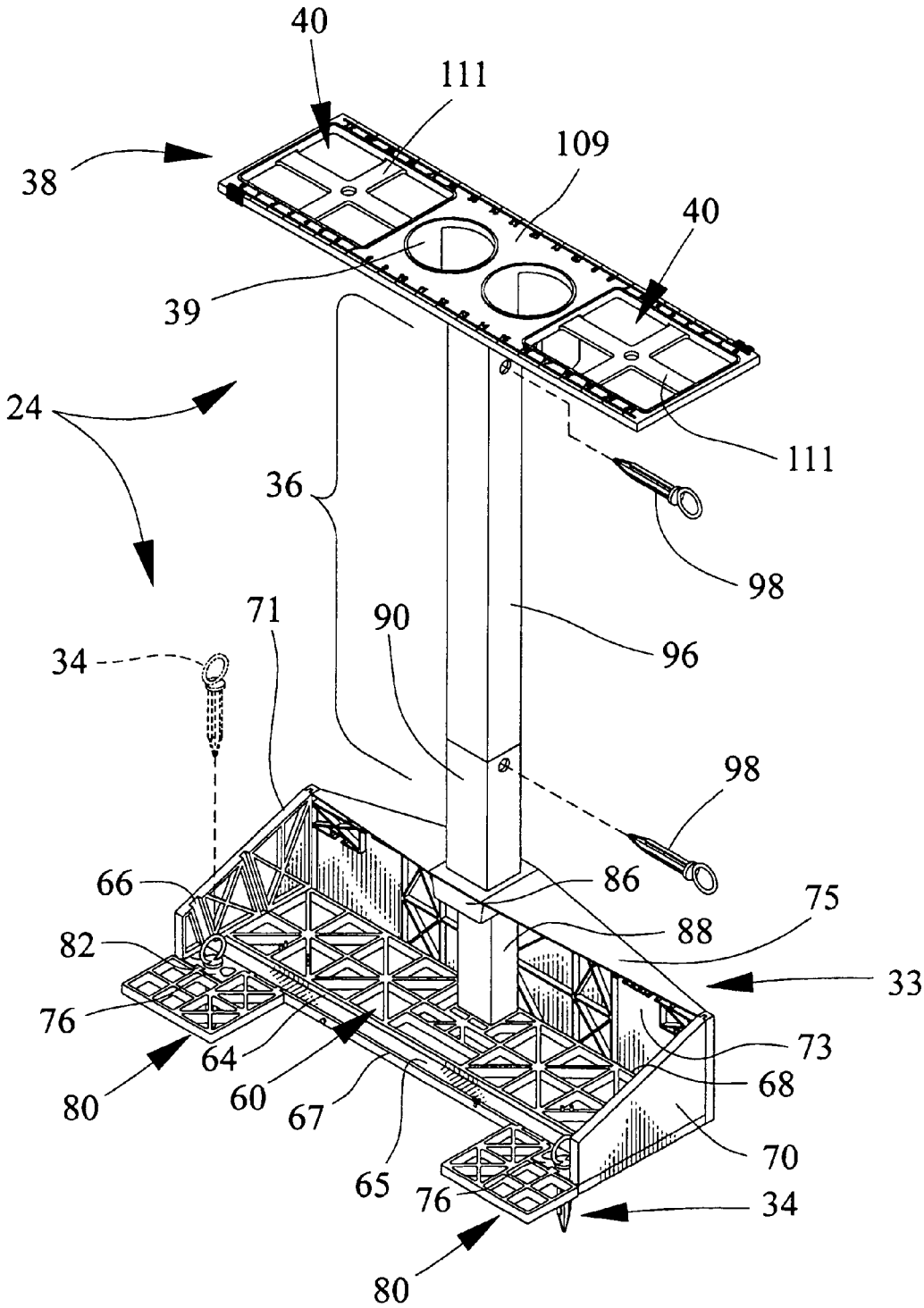
FIG. 8 is an enlarged frontal isometric view of the preferred stabilizing assembly.
Figure 9:
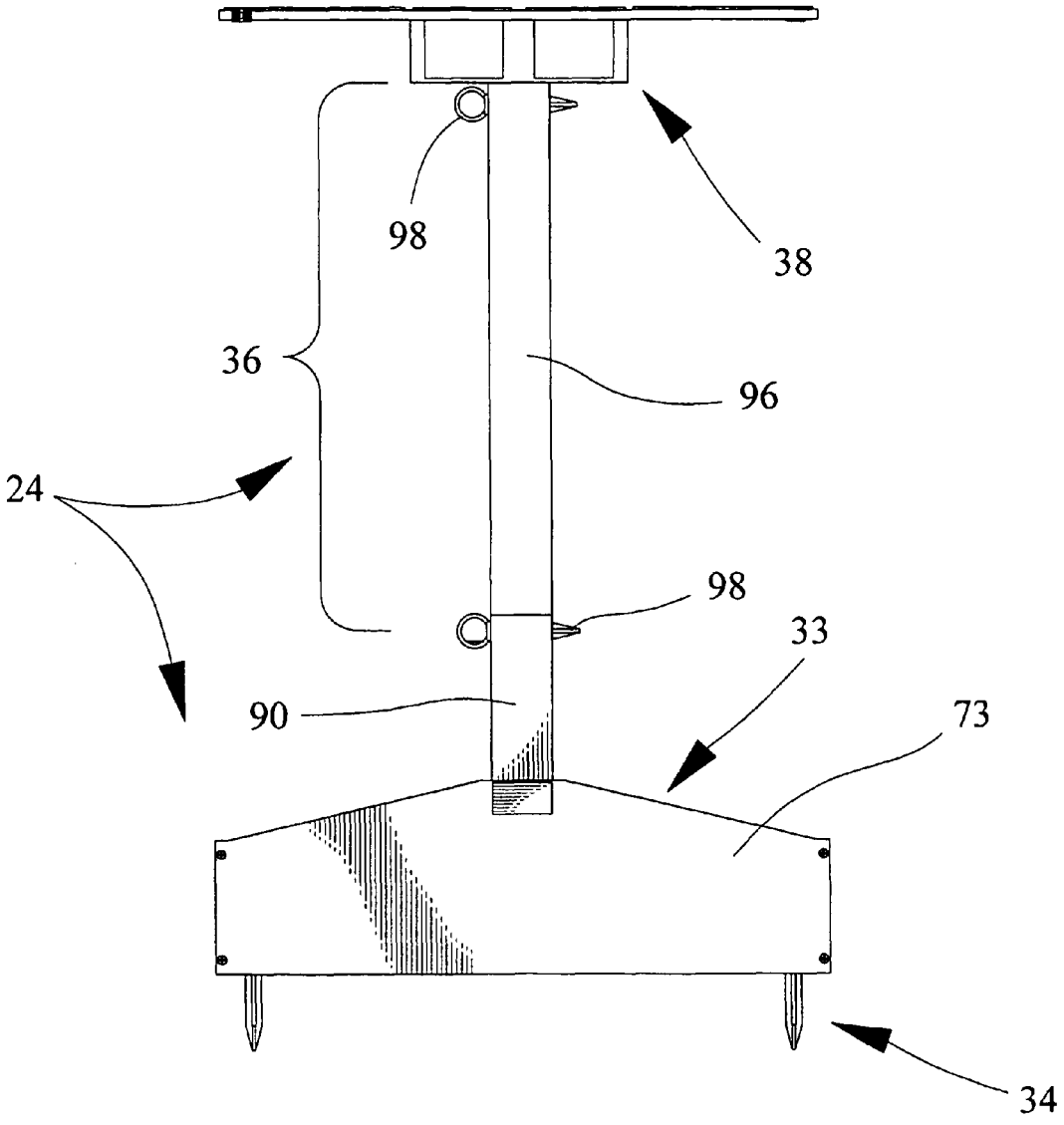
FIG. 9 is an enlarged rear elevational view of the stabilizing assembly of FIG. 8.
Figure 10:
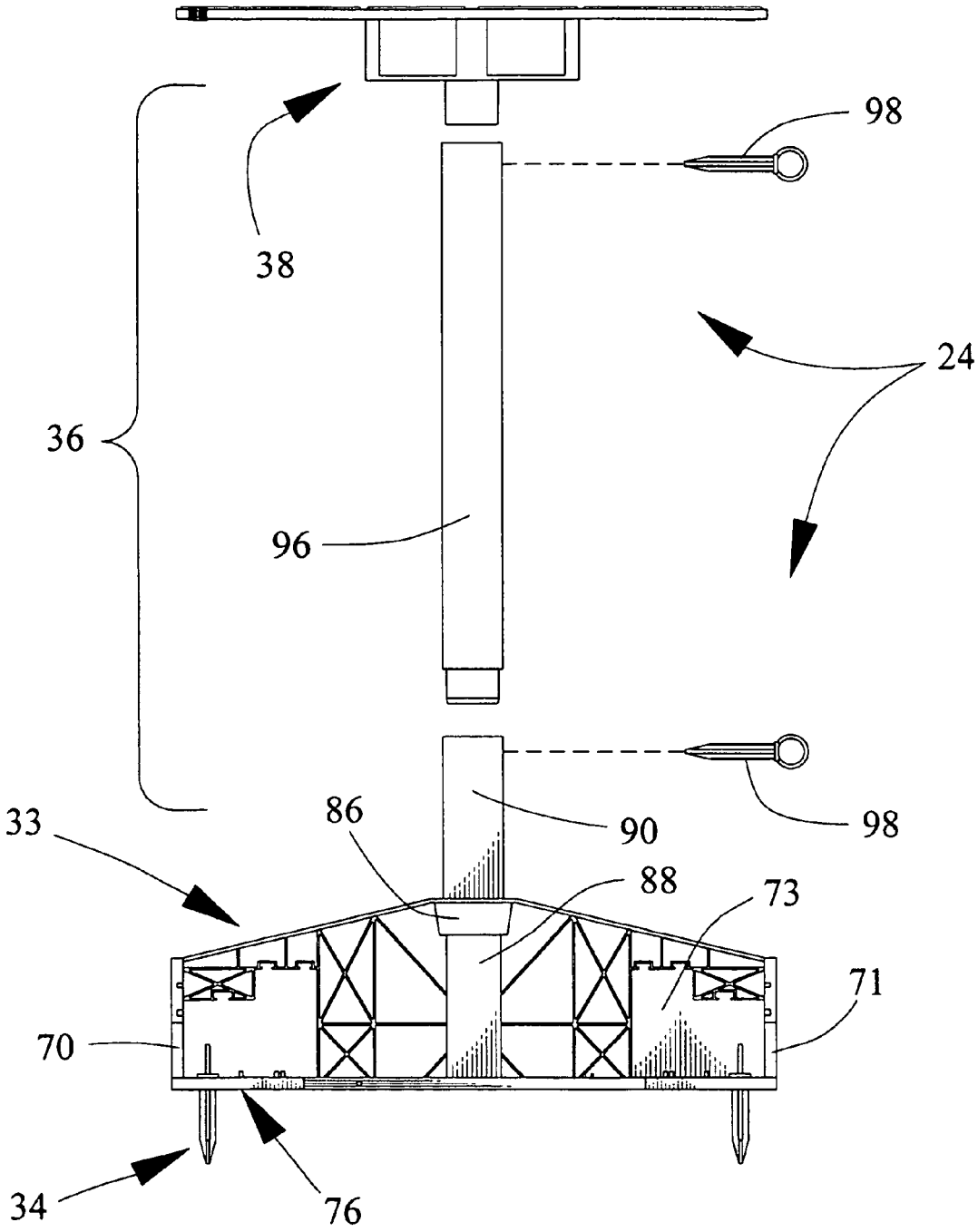
FIG. 10 is a front plan view of the stabilizing assembly.
Figure 11:
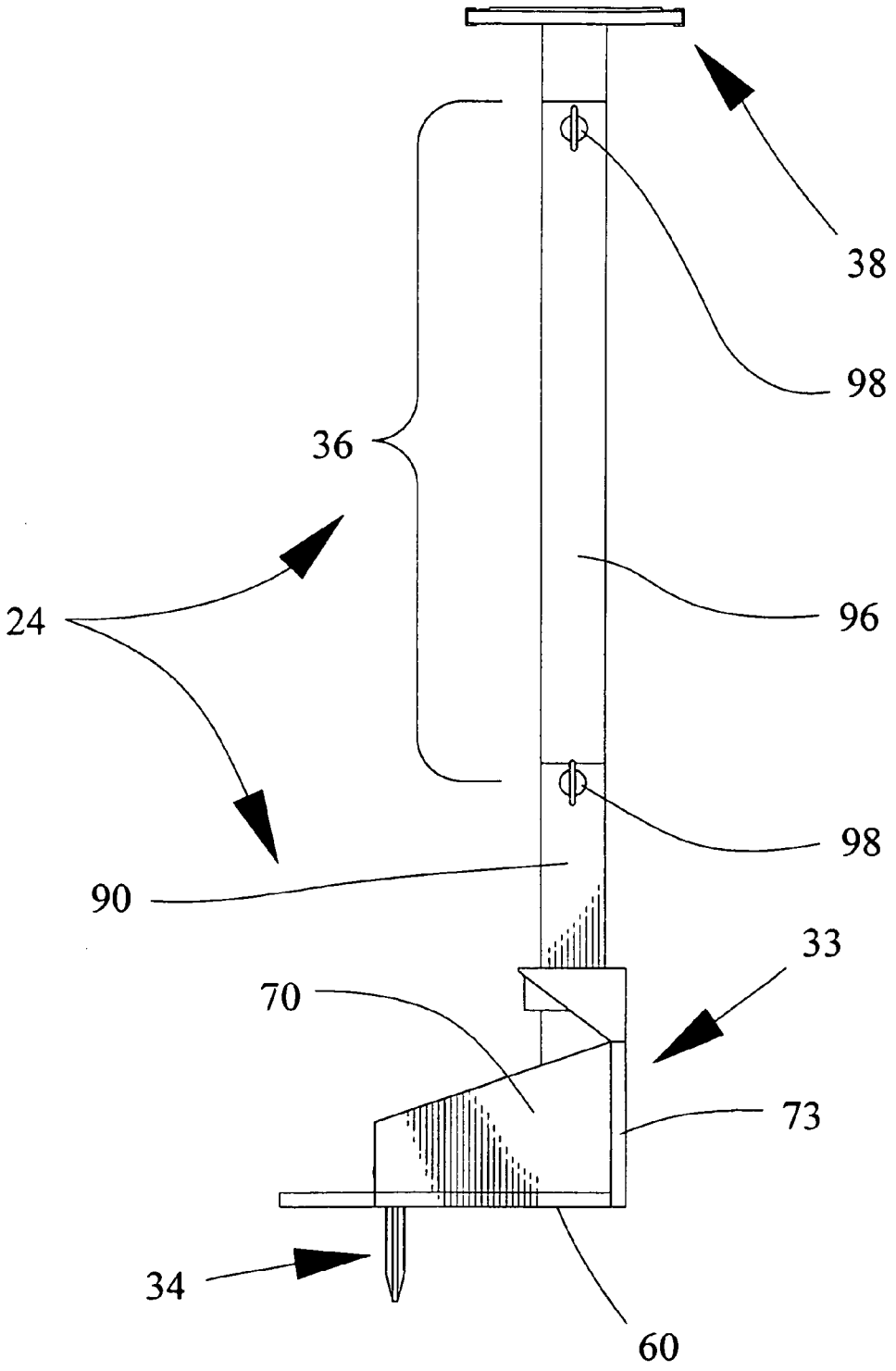
FIG. 11 is a side elevational view of the stabilizing assembly.

Lip 67 is spaced apart from a parallel, inner lip 64 on opposite sides of an elongated slot 65 to which elevator 30 is mated when the target assembly is coupled to the stabilizing assembly 24 during play. When elevator 30 is gently pressed into slot 65, the leading edge of the elevator flushly nests within slot 65 between lips 64, 67 (FIG. 8). However, opposite ends of slot 65 are slidably received within and grasped between angled guide channels 66 formed in each sidewall 71. Sidewall guide channels 66 receive and guide ends of elevator 30 when the elevator is connected to the stabilizing assembly, forcing the elevator 30 to maintain a slight angular configuration relative to the stabilizing assembly.

Figure 12:
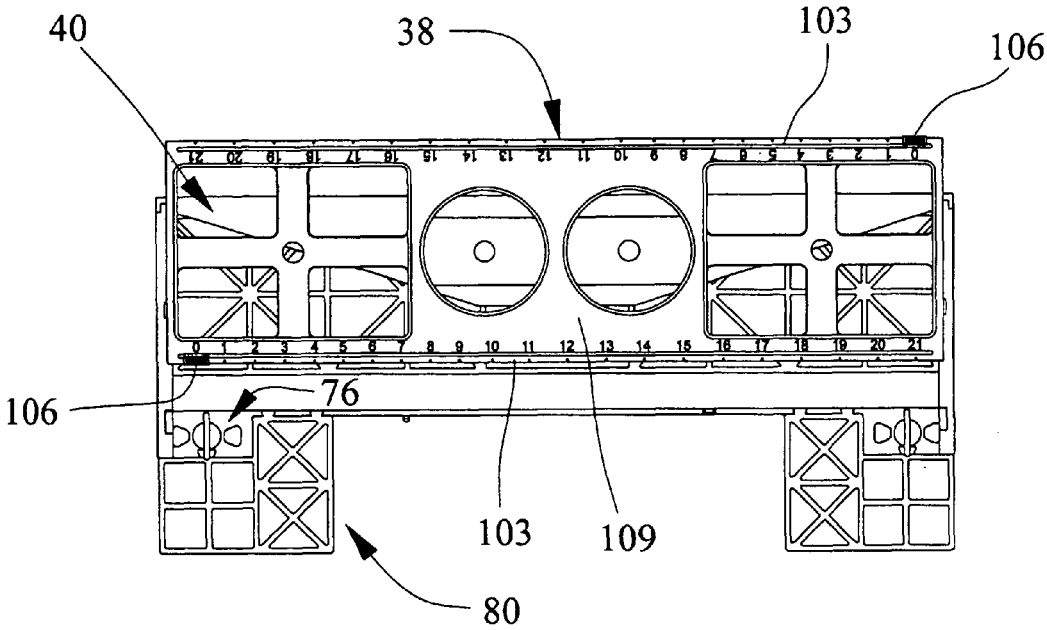
FIG. 12 is an enlarged top plan view of the stabilizing assembly.

As best seen in FIGS. 8 and 12, a rigid, integral anchor region 76 is defined in the front of the base bottom 60 at each end. Each of these relatively small, generally rectangular anchor regions 76 includes a reinforced orifice 78 for selectively receiving removable plastic anchor pins 34, comprising part of an anchoring means. Pins 34 can be forced downwardly through orifice 78 (i.e., FIG. 10) into engagement with the ground 21 (FIG. 1) to secure the target assembly and prevent movement when vigorously thrown bags 25 impact the assembly during play.

Figure 13:
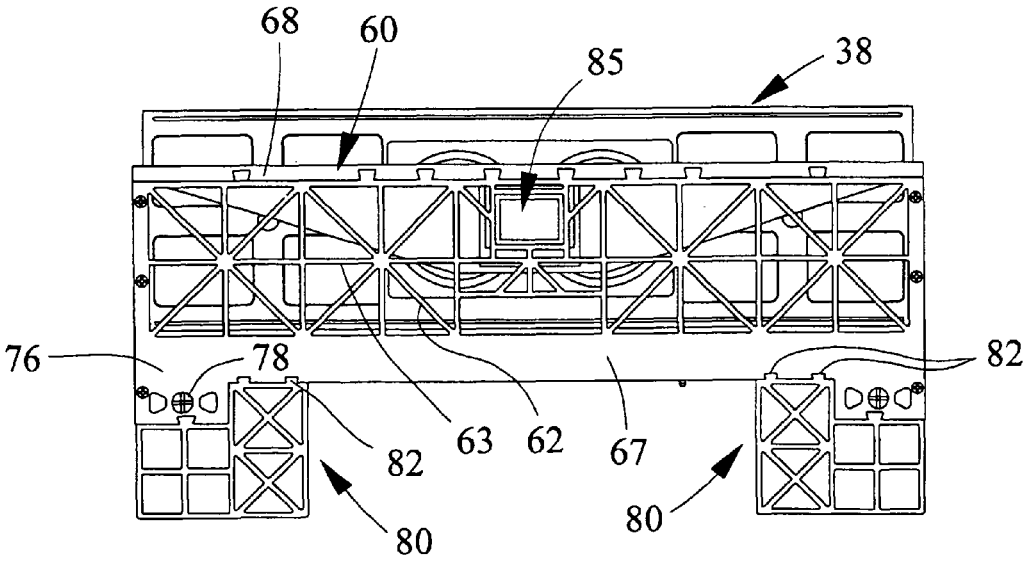
FIG. 13 is an enlarged bottom plan view of the stabilizing assembly.
Figure 14:
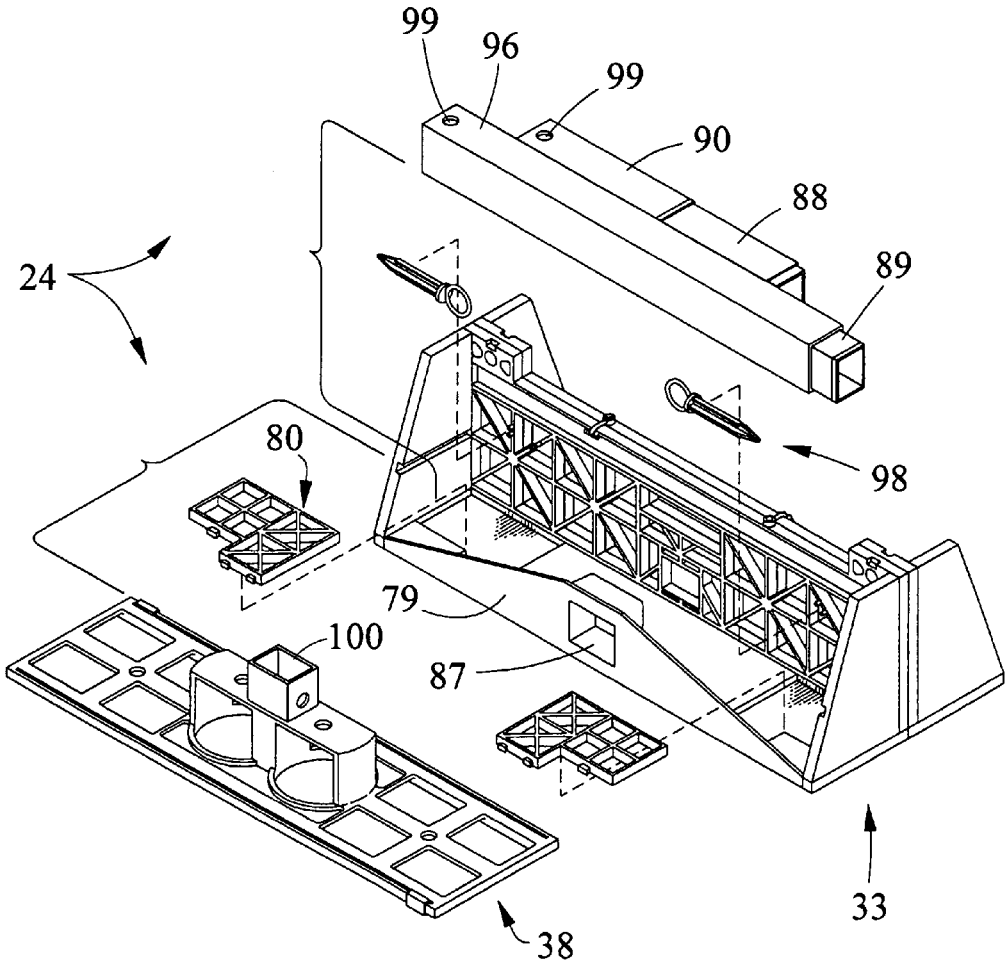
FIG. 14 is an exploded isometric view of the stabilizing assembly.

Importantly, integral anchor regions 76 can be supplemented by a pair of anchor inserts 80 that can be selectively snap fitted to bottom 60 (FIGS. 8, 13). Each insert 80 is generally rectangular, including a clearance slot defined in the corner that clears integral anchor region 76 when assembled. Preferably each anchor insert 80 has a plurality of rigid coupling tangs 82 that snap fit into suitable slots defined in bottom 60. Anchor inserts 80 are normally deployed when the playing surface 21 (FIG. 1) is too rigid or hard to easily receive pins 34, when, for example, the game is played indoors over a carpet or tiled floor.

Preferably the bottom 60 is provided with an integral socket 85 at its rear center. Socket 85 comprises a generally rectangular orifice bounded by plastic walls that are integral with ribs 62, 63. A cooperating clearance passageway 86 (FIG. 10) is defined above socket 85 within shroud 75 to support the stanchion 36 and its elevated shelf platform 38.

Figure 7:
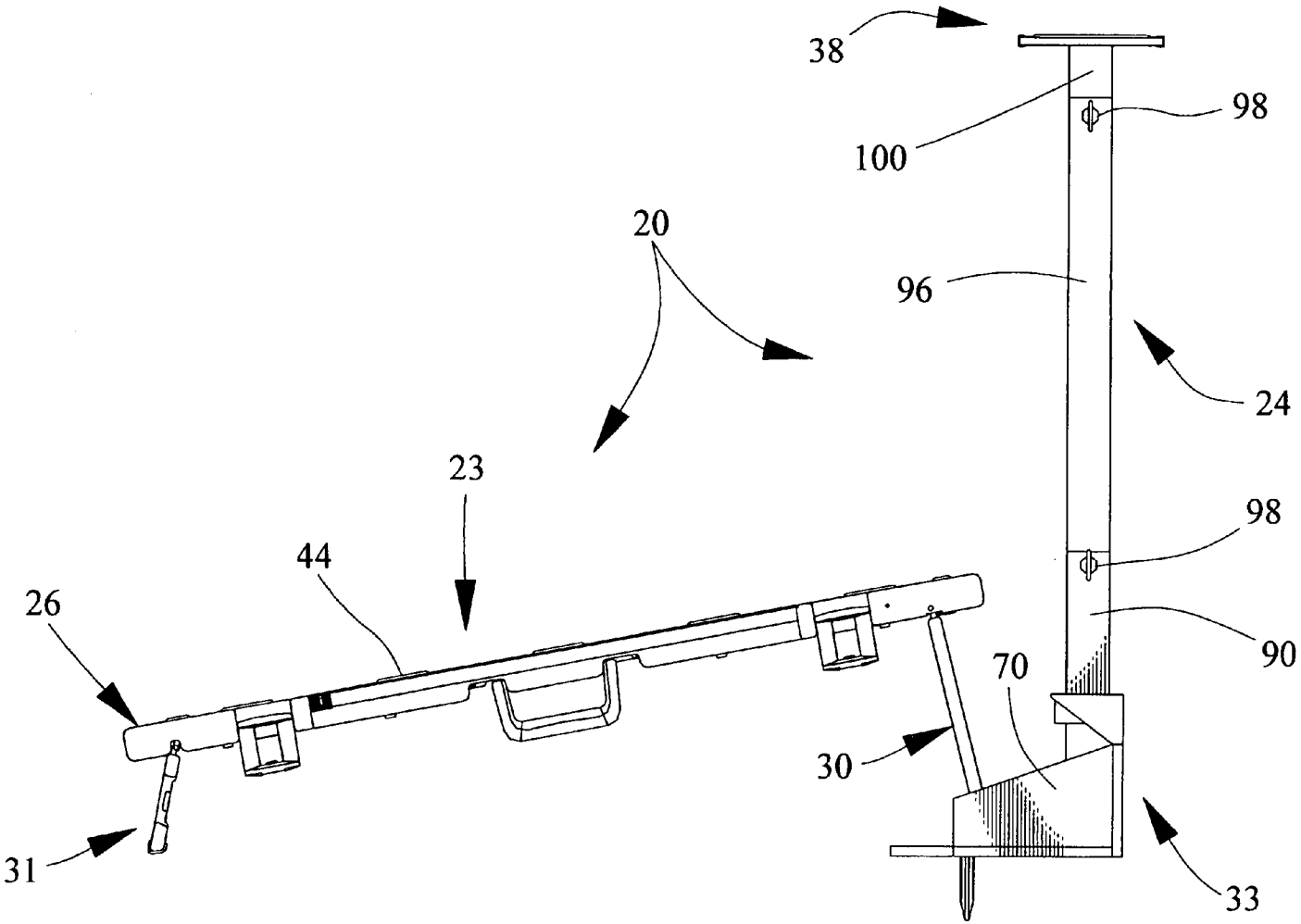
FIG. 7 is a right side elevational view thereof.

Then stanchion 36 is preferably segmented so that it can be user-assembled by fitting the parts together lengthwise. A lowermost stanchion piece 88 coupled to socket 85 penetrates the upper clearance passageway 86 (i.e., FIG. 10) through orifice 87 (FIG. 14) and projects upwardly. A second stanchion piece 90, whose inner dimensions are sized to mate with companion stanchion pieces, projects upwardly where it similarly mates with a third stanchion piece 96 (FIGS. 7, 8). Each stanchion piece has a reduced dimension projection 89 that fits within the open end of the next stanchion piece. Preferably the coupled stanchion ends are retained by a plastic pin 98 (FIG. 8) that is similar to anchor pins 34 discussed previously, and which penetrates orifices 99 (FIG. 14) when the stanchion is assembled. The top of third stanchion piece 96 fits in this manner to the coupling 100 projecting beneath the shelf platform 38.

With primary reference directed now to FIG. 12, the stabilizing assembly shelf platform 38 is generally rectangular, and it preferably molded. The exposed upper top surface (i.e., FIGS. 8, 12) has a pair of integral, projecting scoring rails 103 disposed at its front and rear. Scoring markers 106 are slidably captivated upon rails 103. In the best mode, the numbers zero through twenty-one are permanently molded into the platform 38 proximate the scoring rails 103. As scoring occurs, these markers 106 can be manually moved into a position proximate the numbers to indicate score.

The beverage or cup holding receptacles 39 comprise circular orifices molded into the body of shelf platform 38. Preferably they are disposed above the stanchion 36, within central region 109 of the shelf. The bag storage regions 40 are recessed, comprising generally rectangular depressions located on either side of the cup holders 39. A pair of integral, intersecting interior support rails 111 forms the bottom of each bag support.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A bag tossing game for one or more players, the game comprising:

at least one target assembly adapted to be disposed over a suitable supporting surface, each target assembly comprising an inclined impact surface towards which projectiles may be thrown, an elevator, and a target aperture defined in said surface;

a plurality of bags for tossing by said players at said target assemblies;

a separate stabilizing assembly to which each of said target assemblies may be selectively attached, each stabilizing assembly comprising:

a base adapted to be disposed upon a supporting surface, the base comprising a generally planar bottom, a pair of spaced-apart sidewalls, and an elongated slot extending transversely between said sidewalls to which said elevator is nested when said target assembly is coupled to said stabilizing assembly;

wherein each of said base sidewalls comprises a guide channel for slidably receiving and grasping said elevator when said target assembly is coupled to said stabilizing assembly thus maintaining the elevator at an inclined angle;

a shelf disposed above said base for selectively supporting bags, beverages, or the like;

stanchion means for supporting said shelf above said base.

2. The tossing game as defined in claim 1 wherein said base comprises socket means for interconnecting each stanchion means and said stanchion means comprises a plurality of pieces that are adapted to be interconnected.

3. The tossing game as defined in claim 2 wherein said stabilizing assembly base comprises anchor means comprising at least one pin and at least one orifice through which said pin may be inserted for anchoring said game.

4. The tossing game as defined in claim 3 wherein said anchor means base further comprises supplemental anchor inserts that can be selectively snap fitted to the stabilizing assembly.

5. A bag tossing game for one or more by players, the game comprising:

a pair of target assemblies adapted to be disposed over a suitable supporting surface, each target assembly comprising an inclined impact surface towards which projectiles may be thrown and a target aperture defined in said surface;

elevator means for selectively elevating an end of each target assembly;

a plurality of bags for tossing by said players at said target assemblies;

a separate stabilizing assembly to which each of said target assemblies may be selectively attached, each stabilizing assembly comprising:

a base adapted to be disposed upon a supporting surface, the base comprising a generally planar bottom, a pair of spaced-apart sidewalls, and an elongated slot extending transversely between said sidewalls to which said elevator means is nested when said target assembly is coupled to said stabilizing assembly;

wherein each of said base sidewalls comprises a guide channel for slidably receiving and grasping said elevator means when said target assembly is coupled to said stabilizing assembly thus maintaining the elevator means at an inclined angle;

a shelf disposed above said base; and, elongated stanchion means extending vertically upwardly from said base for supporting said shelf.

6. The tossing game as defined in claim 5 further comprising socket means for interconnecting each stanchion means with said base and wherein said stabilizing assembly stanchion means comprises a plurality of pieces that are adapted to be interconnected.

* * * * *